US007621849B1

(12) United States Patent
Tsai

(10) Patent No.: US 7,621,849 B1
(45) Date of Patent: Nov. 24, 2009

(54) STEPPER

(76) Inventor: Cheng-Ta Tsai, 2F No. 298, Rueiguang Rd., Neihu Dist., Taipei (TW)

( * ) Notice: Subject to any disclaimer, the term of this patent is extended or adjusted under 35 U.S.C. 154(b) by 0 days.

(21) Appl. No.: 12/271,065

(22) Filed: Nov. 14, 2008

(51) Int. Cl.
*A63B 22/04* (2006.01)

(52) U.S. Cl. ..... 482/52; 482/51

(58) Field of Classification Search ..... 482/51–53, 482/57, 70–71, 79, 80; D21/666–668, 670
See application file for complete search history.

(56) References Cited

U.S. PATENT DOCUMENTS 3,970,302 A * 7/1976 McFee ..... 482/53
4,496,147 A * 1/1985 DeCloux et al. ..... 482/53
4,540,172 A * 9/1985 Evans ..... 482/120
4,733,858 A * 3/1988 Lan ..... 482/53
4,900,012 A * 2/1990 Fu ..... 482/52
5,000,442 A * 3/1991 Dalebout et al. ..... 482/70
5,007,631 A * 4/1991 Wang ..... 482/52
5,039,088 A * 8/1991 Shifferaw ..... 482/51
5,180,351 A * 1/1993 Ehrenfried ..... 482/52
5,181,894 A * 1/1993 Shieng ..... 482/70
5,195,935 A * 3/1993 Fencel ..... 482/70
5,222,928 A * 6/1993 Yacullo ..... 482/71
5,267,922 A * 12/1993 Robinson ..... 482/53
5,279,530 A * 1/1994 Hess ..... 482/70
5,279,531 A * 1/1994 Jen-Huey ..... 482/70
5,338,273 A * 8/1994 Metcalf et al. ..... 482/70
5,342,264 A * 8/1994 Gordon ..... 482/70
5,407,409 A * 4/1995 Tang ..... 482/70
5,499,958 A * 3/1996 Hess ..... 482/79
5,792,029 A * 8/1998 Gordon ..... 482/52
5,820,524 A * 10/1998 Chen ..... 482/51
5,893,820 A * 4/1999 Maresh et al. ..... 482/51
5,997,445 A * 12/1999 Maresh et al. ..... 482/70
6,123,650 A * 9/2000 Birrell ..... 482/70
6,165,107 A * 12/2000 Birrell ..... 482/70
6,254,514 B1 * 7/2001 Maresh et al. ..... 482/52
6,579,210 B1 * 6/2003 Stearns et al. ..... 482/52
6,821,231 B1 * 11/2004 Hall ..... 482/51
6,855,093 B2 * 2/2005 Anderson et al. ..... 482/52
6,905,441 B2 * 6/2005 Anderson et al. ..... 482/52
6,926,646 B1 * 8/2005 Nguyen ..... 482/71
7,022,049 B2 * 4/2006 Ryan et al. ..... 482/51
7,052,439 B2 * 5/2006 Anderson et al. ..... 482/52
7,153,238 B2 * 12/2006 Anderson et al. ..... 482/52
7,462,134 B2 * 12/2008 Lull et al. ..... 482/52

(Continued)

*Primary Examiner*—Loan H Thanh
*Assistant Examiner*—Daniel F Roland
(74) *Attorney, Agent, or Firm*—C. G. Mersereau; Nikolai & Mersereau, P.A.

(57) ABSTRACT

A stepper has a base, a treading device, a handle device and two elastic belts. The base has two guide rails. Each guide rail has a guiding wheel. The treading device is movably mounted on the base and has two pedals, two pulley wheels and a pedal cord. The pedals are movably mounted on the guide rails. The pulley wheels are rotatably formed on outer sides of the pedals. The pedal cord is connected to the pedals and mounted around the guiding wheels of the guide rail. The handle device is pivotally connected to the base and the treading device and has two operating bars. Each operating bar has a handle and a holding frame. The holding frame is formed on the operating bar and is mounted around a corresponding pulley wheel. The elastic belts are respectively connected to base and the operating bars of the handle device.

5 Claims, 6 Drawing Sheets

U.S. PATENT DOCUMENTS

| | | | | |
|---|---|---|---|---|
| 7,479,093 | B1 * | 1/2009 | Immordino et al. | 482/52 |
| 2003/0013582 | A1 * | 1/2003 | Anderson et al. | 482/52 |
| 2003/0013583 | A1 * | 1/2003 | Anderson et al. | 482/52 |
| 2003/0060335 | A1 * | 3/2003 | Wang | 482/51 |
| 2004/0248705 | A1 * | 12/2004 | Rodgers, Jr. | 482/83 |
| 2004/0248710 | A1 * | 12/2004 | Rodgers, Jr. | 482/86 |
| 2005/0075218 | A1 * | 4/2005 | Anderson et al. | 482/52 |
| 2005/0227817 | A1 * | 10/2005 | Anderson et al. | 482/52 |
| 2006/0223678 | A1 * | 10/2006 | MacLean | 482/51 |
| 2006/0281604 | A1 * | 12/2006 | Stewart et al. | 482/51 |
| 2007/0219063 | A1 * | 9/2007 | Anderson et al. | 482/52 |
| 2007/0219064 | A1 * | 9/2007 | Anderson et al. | 482/52 |
| 2007/0219065 | A1 * | 9/2007 | Anderson et al. | 482/52 |
| 2007/0232457 | A1 * | 10/2007 | Porth | 482/51 |
| 2008/0312045 | A1 * | 12/2008 | Lull et al. | 482/52 |

* cited by examiner

STEPPER

BACKGROUND OF THE INVENTION

1. Field of the Invention

The present invention relates to an exercise machine, and more particularly to a stepper with alternate motion.

2. Description of Related Art

A conventional stepper has a base, two pedals and two handles. The base has a top and two sides. The pedals are pivotally mounted on the top of the base. The handles are securely or pivotally connected to the sides of the base. An exerciser stands on the pedals and holds the handles to tread on the pedals and simulate climbing steps. However, the exerciser must use an opposite hand and foot so is limiting.

To overcome the shortcomings, the present invention provides a stepper to mitigate or obviate the aforementioned problems.

SUMMARY OF THE INVENTION

The main objective of the present invention is to provide a stepper with alternate motion.

The stepper in accordance with the present invention has a base, a treading device, a handle device and two elastic belts. The base has two guide rails. Each guide rail has a guiding wheel. The treading device is movably mounted on the base and has two pedals, two pulley wheels and a pedal cord. The pedals are movably mounted on the guide rails. The pulley wheels are respectively and rotatably formed on outer sides of the pedals. The pedal cord is connected to the pedals and is mounted around the guiding wheels of the guide rail. The handle device is pivotally connected to the base and the treading device and has two operating bars. Each operating bar has a handle and a holding frame. The holding frame is formed on the operating bar and is mounted around a corresponding pulley wheel. The elastic belts are respectively connected to base and the operating bars of the handle device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
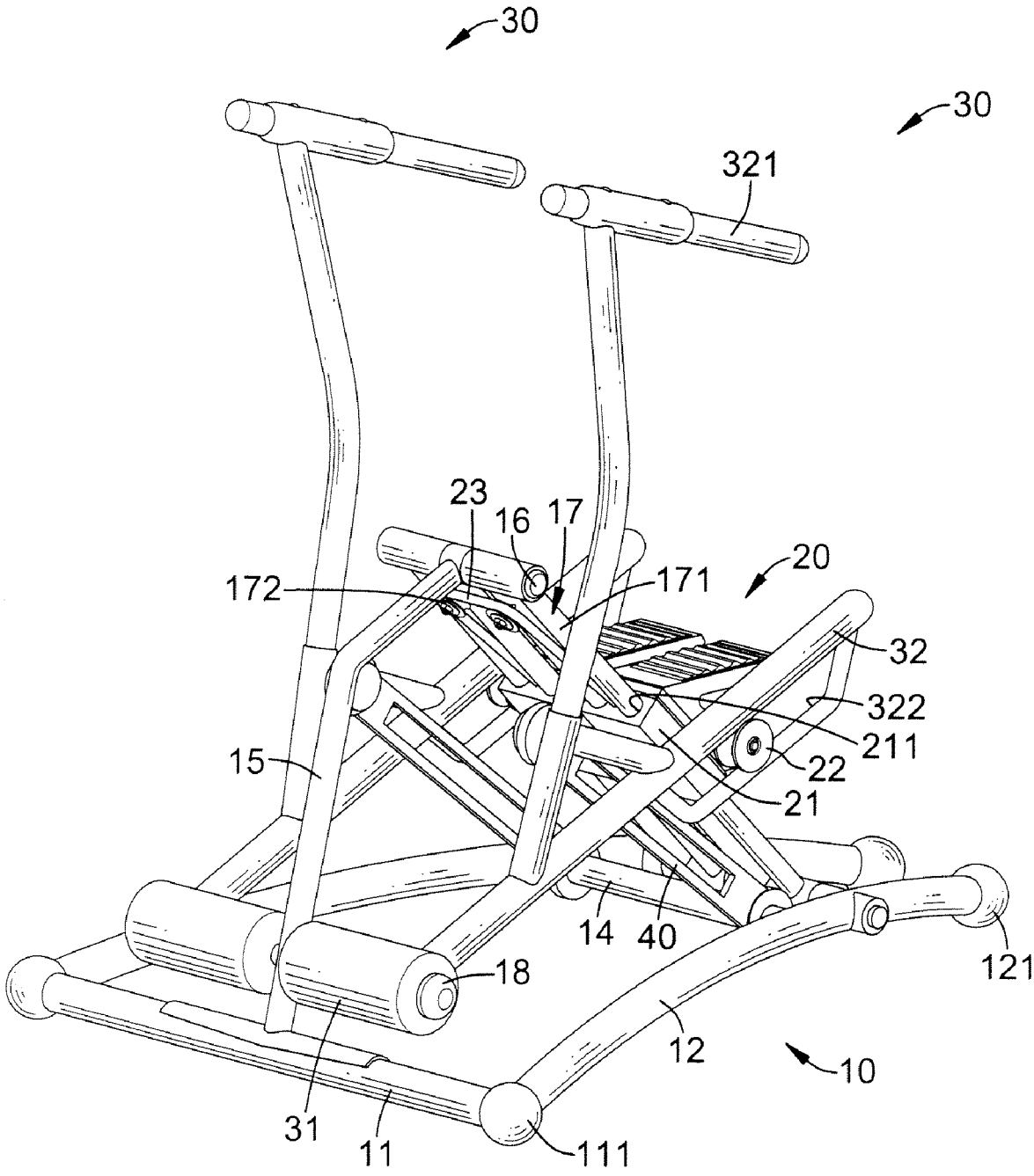
FIG. 1 is a front perspective view of a stepper in accordance with the present invention.
Figure 2:
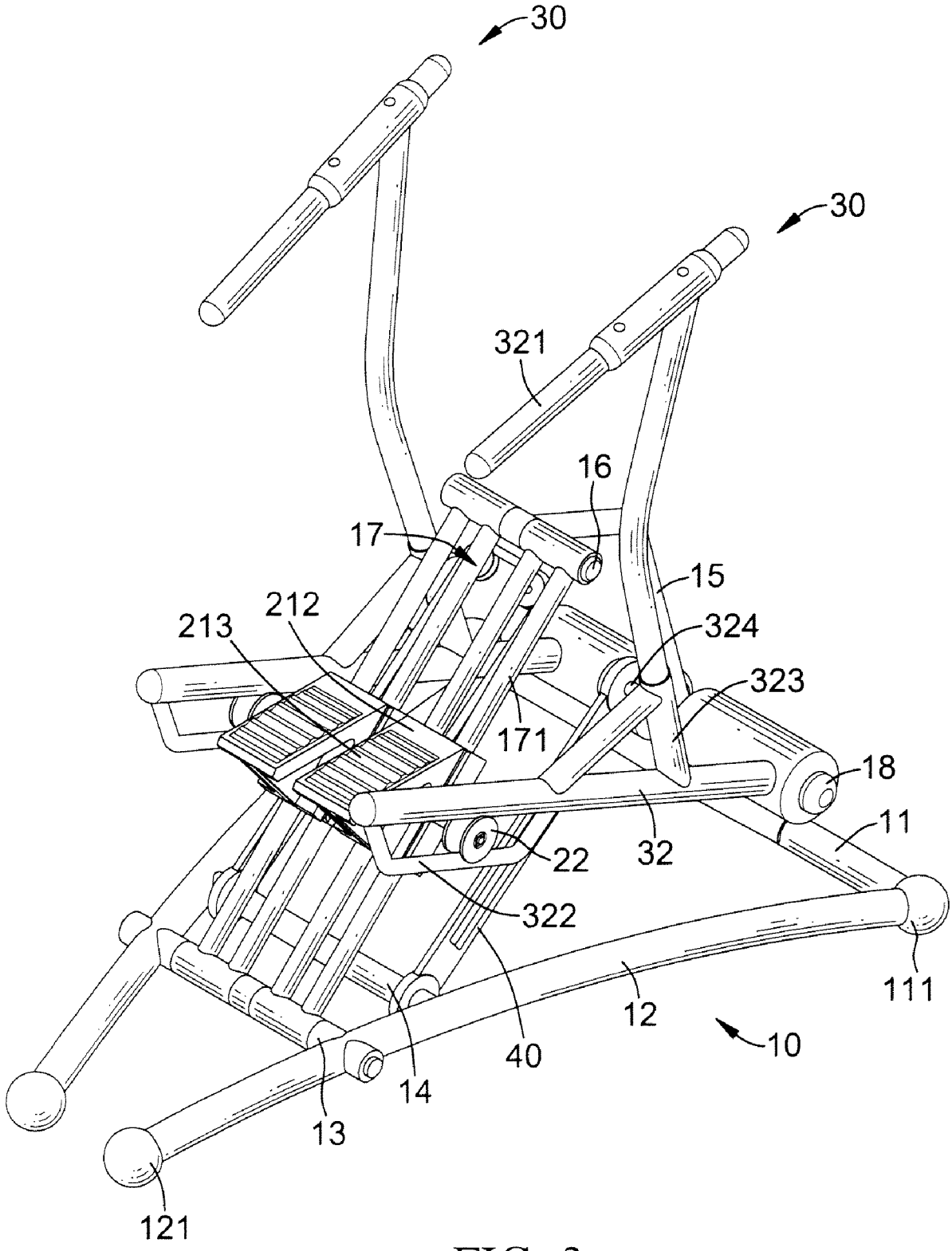
FIG. 2 is a rear perspective view of the stepper in FIG. 1.
Figure 3:
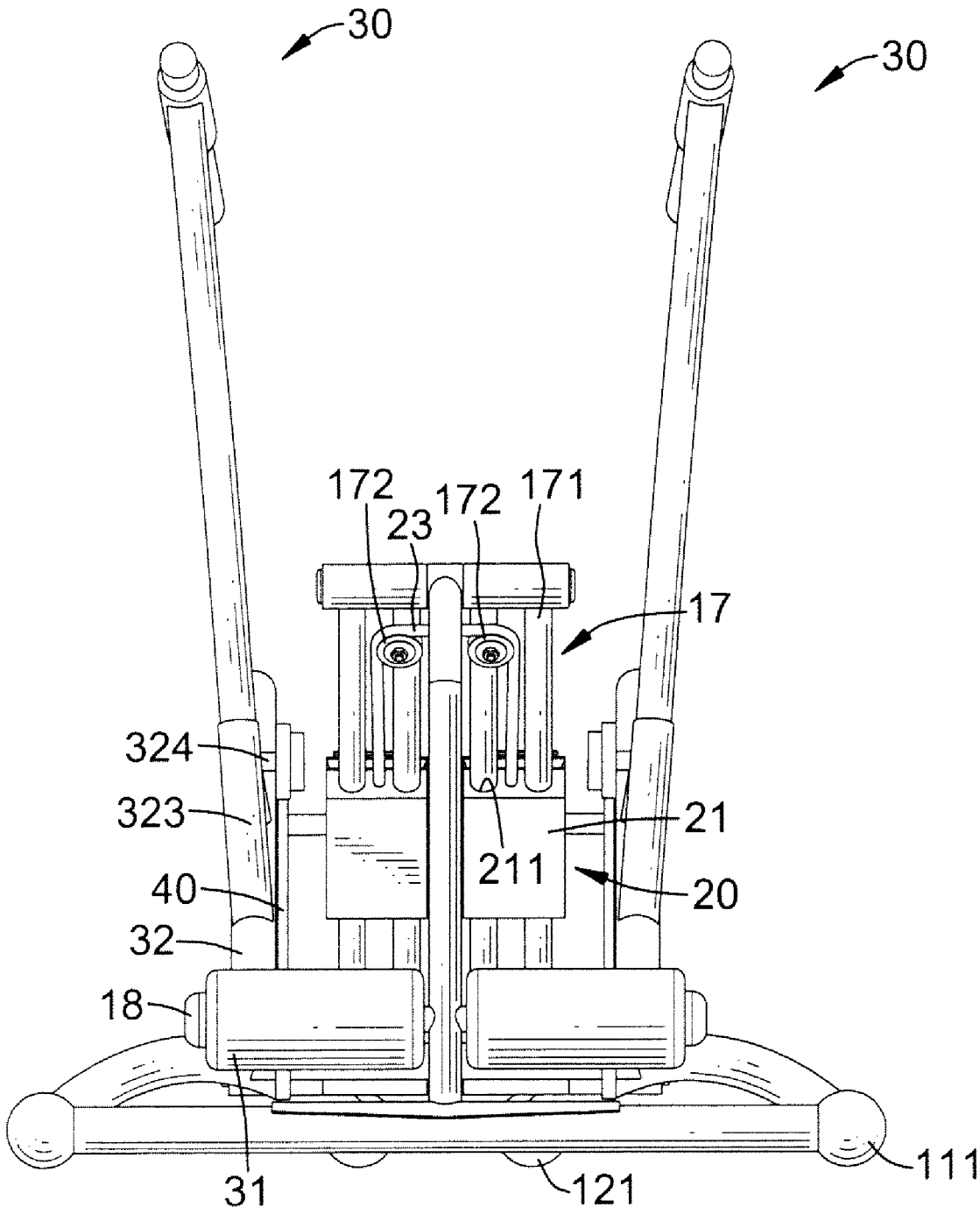
FIG. 3 is a front view of the stepper in FIG. 1.
Figure 4:
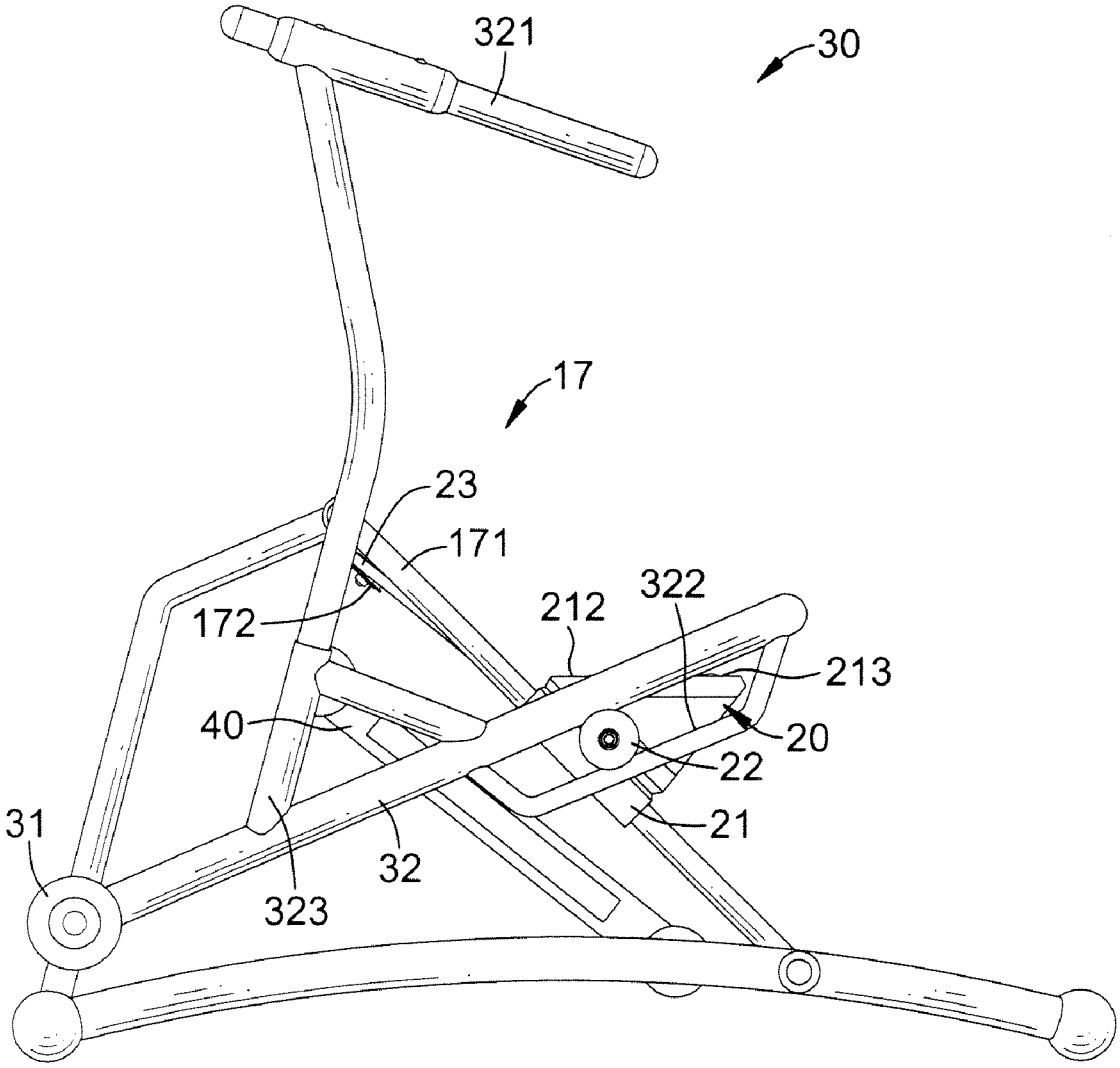
FIG. 4 is a side view of the stepper in FIG. 1.

With reference to FIGS. 1 to 4, a stepper in accordance with the present invention has a base (10), a treading device (20), a handle device (30) and two elastic belts (40).

The base (10) has a front end, a rear end, a front supporting leg (1), two side supporting legs (12), a rear supporting leg (13), a mounting bar (14), a longitudinal bar (15), a connecting bar (16), two guide rails (17) and two pivotal shafts (18).

The front supporting leg (11) is transversally formed on the front end of the base (10) and has a middle, two ends and two foot connectors (111). The foot connectors (111) may be spherical and are respectively formed on the ends of the front supporting leg (11).

The side supporting legs (12) may be curved and are connected to the front supporting leg (11) and each side supporting leg (12) has a front end, a rear end and a foot (121). The front end of each side supporting leg (12) is connected to one of the ends of the front supporting leg (11), may be mounted on one of the foot connectors (111) of the front supporting leg (11). The foot (121) may be spherical and is formed on the rear end of the side supporting leg (12).

The rear supporting leg (13) is transversally formed on the side supporting legs (12) near the rear ends, may be on the feet (121) of the side supporting legs (12).

The mounting bar (14) is transversally formed on the side supporting legs (12) near the rear supporting leg (13).

The longitudinal bar (15) may be an inverted V, is formed on and protrudes from the middle of the front supporting leg (11) and has a bottom end and a top end.

The connecting bar (16) is transversally formed on the top end of the longitudinal bar (15).

The guide rails (17) are parallelly connected to the base (10) and each guide rail (17) has two guiding rods (171) and a guiding wheel (172). The guiding rods (171) of each guide rail (17) are connected to the connecting bar (16) and the rear supporting leg (13), are parallel to each other and each guiding rod (171) has an upper end and a bottom face. The guiding wheel (172) of each guide rail (17) is rotatably mounted on a bottom of the guide rail (17), may be on the bottom face of the guiding rods (171) near the upper ends.

The pivotal shafts (18) are transversally formed on the longitudinal bar (15) above the front supporting leg (11).

The treading device (20) is movably mounted on the base (10) and has two pedals (21), two pulley wheels (22) and a pedal cord (23).

The pedals (21) are movably mounted on guide rails (17), may be on the guiding rods (171) of the guide rails (17) and each pedal (21) has a front side, a rear side, a top, an outer side, two mounting holes (211), a treading face (212) and multiple ribs (213). The mounting holes (211) are formed through the pedal (21) from the front side to the rear side and are respectively mounted around the guiding rods (171) of the guide rail (17). The treading face (212) is horizontally formed on the top of the pedal (21). The ribs (213) are formed on the treading face (212) to prevent an exerciser slipping on the pedals (21).

The pulley wheels (22) are respectively and rotatably formed on the outer sides of the pedals (21).

The pedal cord (23) is connected to the front sides of the pedals (21) and mounted around the guiding wheels (172) of the guide rails (17) and connects the pedals (21) so one pedal (21) moving downward causes the other pedal (21) to move upward.

The handle device (30) is pivotally connected to the base (10) and the treading device (20) and has two collars (31) and two operating bars (32).

The collars (31) are respectively and rotatably mounted around the pivotal shafts (18) of the base (10) and each collar (31) has an external surface.

The operating bars (32) may be M-shaped and are rotatably connected to the base (10), may be respectively formed on and protrude upward from the external surfaces of the collars (31) and each operating bar (32) has a lower end, an upper end, an external surface, a handle (321), a holding frame (322), an extended arm (323) and a linking rod (324). The lower end of the operating bar (32) is connected to the base (10) near the front end and may be formed on a corresponding collar (31). The handle (321) is formed on the upper end of the operating bar (32). The holding frame (322) is formed on the external surface of the operating bar (32) near the lower end and is mounted around one of the pulley wheels (22) of the treading device (20). The extended arm (323) may be V-shaped, is formed on the external surface of the operating bar (32) near the holding frame (322) and has an inner side and an apex. The linking rod (324) is formed on and protrudes from the inner side of the extended arm (323) near the apex.

The elastic belts (40) are respectively connected to the mounting bar (14) and the operating bars (32), may be at the linking rods (324).

Figure 5:
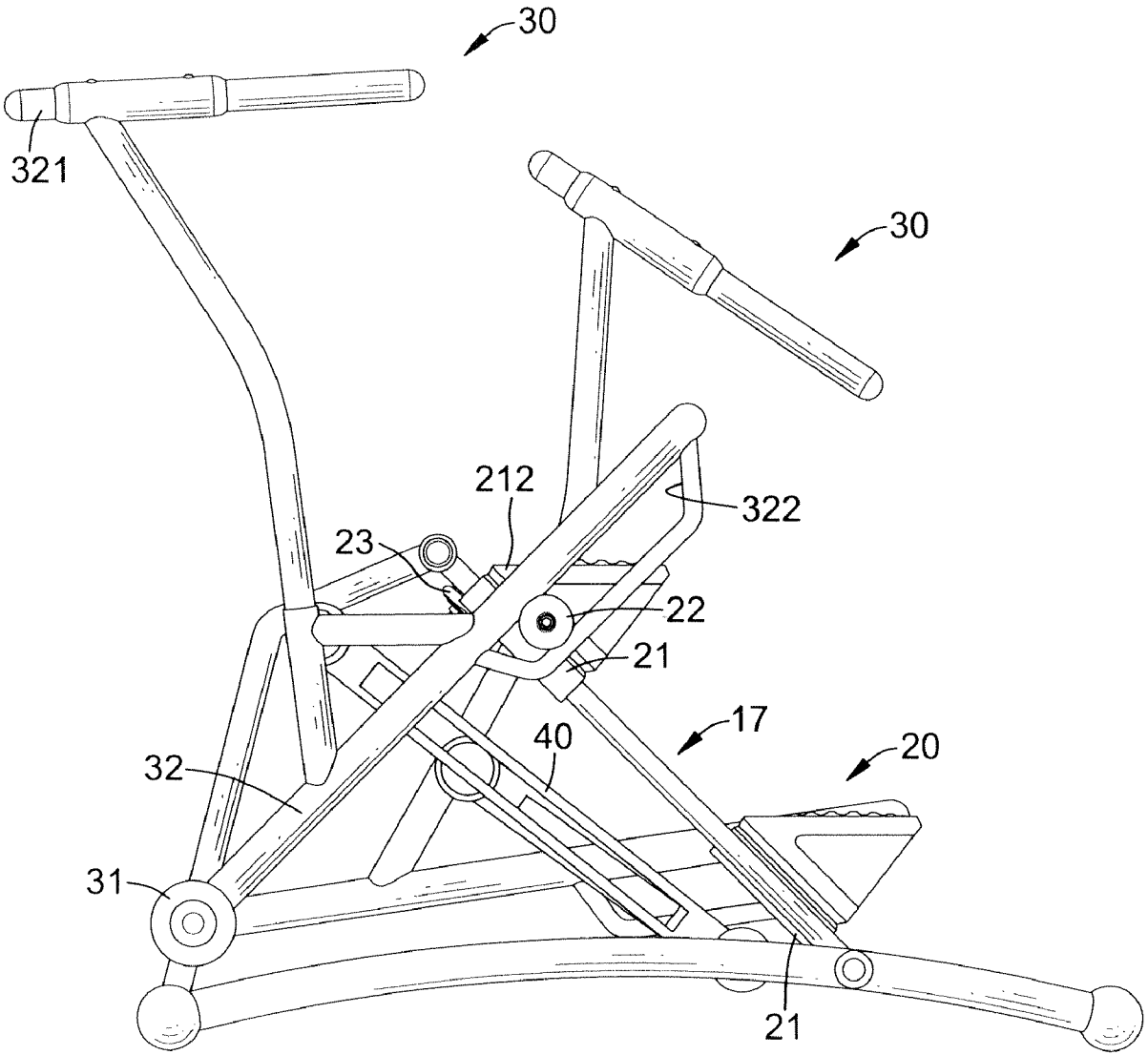
FIG. 5 is an operational side view of the stepper in FIG. 1.
Figure 6:
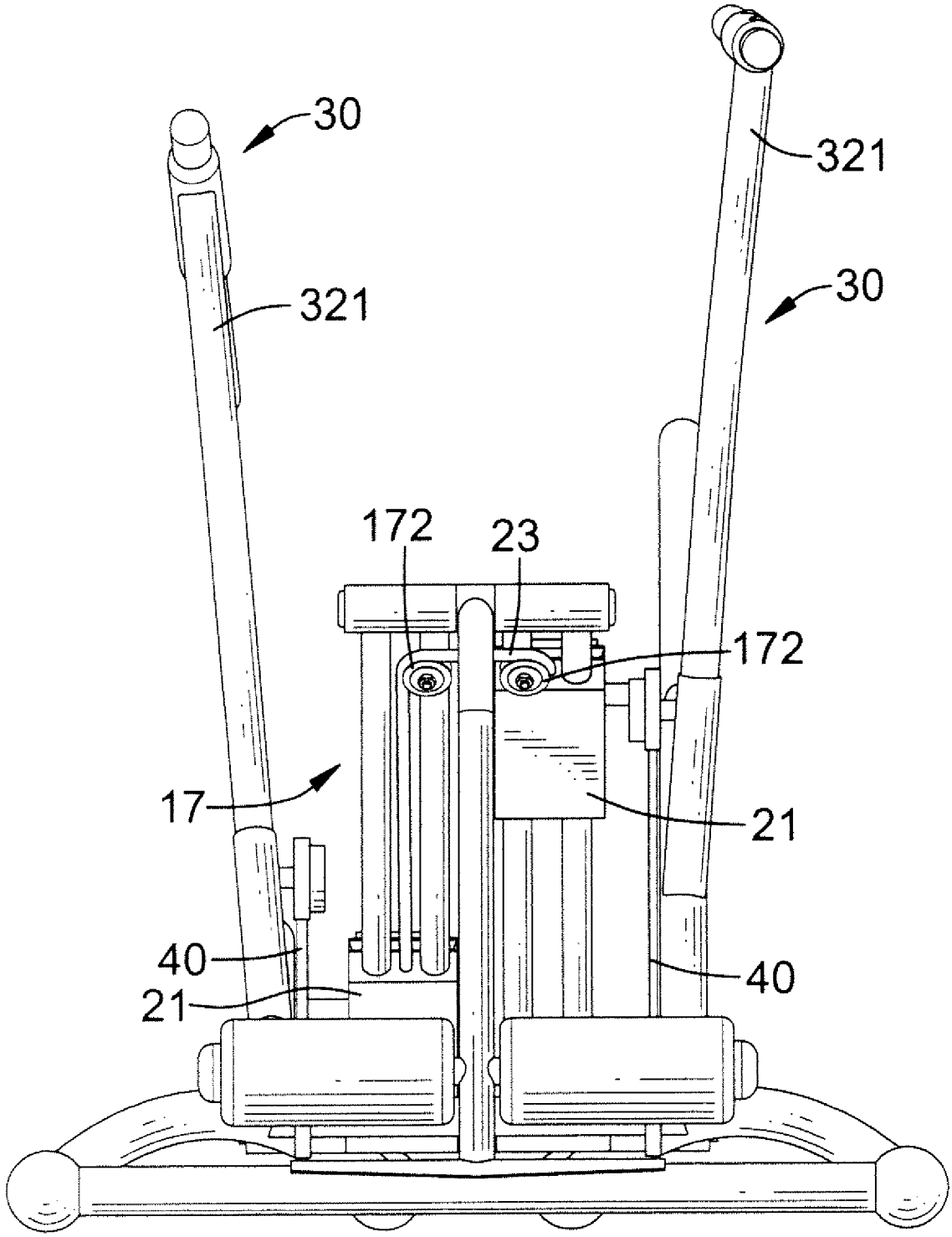
FIG. 6 is an operational front view of the stepper in FIG. 1.

With further reference to FIGS. 5 and 6, when using the stepper in accordance with the present invention to exercise, an exerciser's feet are placed on the treading faces (212) of the pedals (21) and the hands are held on the handles (32) of the handle device (30). The pedals (21) are alternatively pressed downward. When the pedals (21) are moved upward or downward relative to the guide rails (17) of the base (10), the pulley wheels (22) on the outer sides of the pedals (21) can move relative to the holding frames (322) of the handles (32) and this can make the handles (32) swing in a same direction with the pedals (21). Therefore, feet and hands on one side are exercised alternately with the other side. Furthermore, the elastic belts (40) are respectively connected to the mounting bar (14) and the linking rods (324) of the operating bars (32) and this can provide a returning force and a damping force for the handle device (30). Therefore, the stepper in accordance with the present invention can be used smoothly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A stepper having a base having a front end;

a rear end;

a front supporting leg being transversally formed on the front end of the base and having a middle; and two ends;

two side supporting legs being connected to the front supporting leg and each side supporting leg having a front end being connected to one of the ends of the front supporting leg; and a rear end;

a rear supporting leg being transversally formed on the side supporting legs near the rear ends of the side supporting legs;

a mounting bar being transversally formed on the side supporting legs near the rear supporting leg;

a longitudinal bar being formed on and protruding from the middle of the front supporting leg and having a bottom end; and a top end;

a connecting bar being transversally formed on the top end of the longitudinal bar;

two guide rails being parallelly connected to the base and each guide rail having two guiding rods being connected to the connecting bar and the rear supporting leg, being parallel to each other and each guiding rod having an upper end; and a bottom face;

a guiding wheel being rotatably mounted on the bottom faces of the guiding rods near the upper ends; and two pivotal shafts being transversally formed on the longitudinal bar above the front supporting leg;

a treading device being movably mounted on the base and having two pedals being movably mounted on the guiding rods of the guide rails and each pedal having a front side;

a rear side:

an outer side; and two mounting holes being formed through the pedal from the front side to the rear side and being respectively mounted around the guiding rods of the guide rail;

two pulley wheels being respectively and rotatably formed on the outer sides of the pedals; and a pedal cord being connected to the front sides of the pedals and being mounted around the guiding wheels of the guide rails;

a handle device being pivotally connected to the base and the treading device and having two collars being respectively and rotatably mounted around the pivotal shafts of the base and each collar having an external surface; and two operating bars being rotatably connected to the base and each operating bar having a lower end being connected to the base near the front end of the base and being formed on and protruding upward from the external surfaces of a corresponding collar;

an upper end;

an external surface;

a handle being formed on the upper end of the operating bar; and a holding frame being formed on the external surface of the operating bar near the lower end and being mounted around one of the pulley wheels of the treading device;

an extended arm being formed on the external surface of the operating bar near the holding frame and having an inner side;

an apex; and a linking rod being formed on and protruding from the inner side of the extended arm near the apex; and two elastic belts being respectively connected to base and the linking rods of the operating bars of the handle device.

2. The stepper as claimed in claim 1, wherein the front supporting leg further has two spherical foot connectors being respectively formed on the ends of the front supporting leg; and the side supporting legs are curved and each side supporting leg further has a spherical foot being formed on the rear end of the side supporting leg; and the front ends of the side supporting legs are mounted on the foot connectors of the front supporting leg.

3. The stepper as claimed in claim 2, wherein each pedal further has a top;

a treading face being horizontally formed on the top of the pedal; and multiple ribs being formed on the treading face.

4. The stepper as claimed in claim 3, wherein the longitudinal bar is an inverted V;

each operating bar is M-shaped; and each extended arm is V-shaped.

5. The stepper as claimed in claim 1, wherein each pedal further has a top;

a treading face being horizontally formed on the top of the pedal; and multiple ribs being formed on the treading face.

* * * * *